US009181779B2

(12) United States Patent
Richards

(10) Patent No.: US 9,181,779 B2
(45) Date of Patent: Nov. 10, 2015

(54) ACTIVATED REVERSE-OUT VALVE

(71) Applicant: Halliburton Energy Services, Inc., Houston, TX (US)

(72) Inventor: William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/382,641

(22) PCT Filed: Nov. 1, 2013

(86) PCT No.: PCT/US2013/068037
§ 371 (c)(1),
(2) Date: Sep. 3, 2014

(87) PCT Pub. No.: WO2015/065473
PCT Pub. Date: May 7, 2015

(65) Prior Publication Data

US 2015/0211334 A1 Jul. 30, 2015

(51) Int. Cl.
*E21B 34/14* (2006.01)
*E21B 43/04* (2006.01)
*E21B 34/00* (2006.01)

(52) U.S. Cl.
CPC ..... *E21B 34/14* (2013.01); *E21B 43/04* (2013.01); *E21B 2034/005* (2013.01)

(58) Field of Classification Search
CPC ..... E21B 34/14; E21B 33/12; E21B 43/04; E21B 2034/005
See application file for complete search history.

(56) References Cited

U.S. PATENT DOCUMENTS

| | | | | |
|---|---|---|---|---|
| 4,671,361 | A | 6/1987 | Bolin | |
| 6,216,785 | B1 | 4/2001 | Achee, Jr. et al. | |
| 7,523,787 | B2 | 4/2009 | Richards et al. | |
| 2007/0114043 | A1 * | 5/2007 | Richards et al. | 166/386 |
| 2009/0173503 | A1 | 7/2009 | Corbett et al. | |
| 2010/0032155 | A1 * | 2/2010 | Darnell et al. | 166/188 |
| 2011/0042107 | A1 * | 2/2011 | Chambers et al. | 166/386 |
| 2011/0048706 | A1 | 3/2011 | Clem et al. | |

FOREIGN PATENT DOCUMENTS

WO 2015065473 A1 5/2015

OTHER PUBLICATIONS

International Search Report and Written Opinion for PCT/US2013/068037 dated Jul. 24, 2014.

* cited by examiner

*Primary Examiner* — Nicole Coy
*Assistant Examiner* — Kristyn Hall
(74) *Attorney, Agent, or Firm* — McDermott Will & Emery LLP; Scott Richardson

(57) ABSTRACT

Disclosed is a reverse-out valve that minimizes swabbing of subterranean formations. One reverse-out valve includes a first mandrel, a second mandrel movable with respect to the first mandrel, a collet arranged about the first mandrel and having a cover portion and a plurality of fingers that extend axially from the cover portion, wherein each finger provides a collet protrusion defined thereon, a plurality of dogs movably arranged within a corresponding plurality of windows defined in the first mandrel, and a reverse activated plug device movable between an open position, where the plurality of dogs are disposed within a groove defined in the second mandrel and a reverse-circulation fluid is able to bypass the reverse activated plug device, and a closed position, where the plurality of dogs are moved out of the groove and the reverse-circulation fluid is prevented from bypassing the reverse activated plug device.

22 Claims, 9 Drawing Sheets

ACTIVATED REVERSE-OUT VALVE

BACKGROUND

This present disclosure is related to the treatment of subterranean production intervals and, more particularly, to a reverse-out valve that minimizes swabbing of the formation caused by service tool manipulations during the well treatment operation.

In the oil and gas industry, particulate materials such as sand and other wellbore debris are often produced to the surface during the extraction of hydrocarbons from a well traversing unconsolidated or loosely consolidated subterranean formations. Producing such particulate matter can cause abrasive wear to components within the well, such as tubing, pumps, and valves, and can sometimes partially or fully clog the well creating the need for an expensive workover operation. Also, if the particulate matter is produced to the surface, it must be removed from the extracted hydrocarbons by various processing equipment at the surface.

In order to prevent the production of such particulate material to the surface, unconsolidated or loosely consolidated production intervals in the well are often gravel packed. In a typical gravel pack completion, a completion string including a packer, a circulation valve, a fluid loss control device and one or more sand control screens, is lowered into the wellbore to a position proximate the desired production interval. A service tool is then positioned within the completion string and a fluid slurry that includes a liquid carrier and a particulate material (i.e., gravel) is then pumped through the circulation valve and into the well annulus formed between the sand control screens and the perforated well casing or open hole production zone. The liquid carrier either flows into the adjacent formation or returns to the surface by flowing through the sand control screens, or both. In either case, the gravel is deposited around the sand control screens to form a gravel pack, which is highly permeable to the flow of hydrocarbon fluids but simultaneously blocks the flow of the particulate material often carried in the hydrocarbon fluids. As such, gravel packs can successfully prevent the problems associated with the production of particulate materials from the formation.

During gravel packing operations, the service tool used to deliver the gravel slurry must be operated between various positions. For example, the service tool typically has a run-in configuration, a gravel slurry pumping configuration and a reverse-out configuration. In order to operate the service tool between these positions, the service tool is axially manipulated relative to the completion string. In addition, the service tool is often used to open and close the circulation valve, which also requires the axial movement of the service tool relative to the completion string. Such axial movement of the service tool, however, can adversely affect the surrounding formation. For instance, movement of the service tool uphole relative to the completion string can undesirably draw production fluids out of the formation, and movement of the service tool downhole can undesirably force wellbore fluids into the formation. This type of swabbing can damage the formation, including causing damage to the filter cake in an open hole completion.

To avoid detrimental swabbing of the wellbore, some tools use a weep tube to move the service tool string. The weep tube allows a controlled rate of fluid to transfer through the service tool and thereby maintain hydrostatic pressure on the surrounding formation. While weep tubes work well for reducing tool movement, weep tubes can also undesirably fracture the surrounding formation during reverse-out operations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

This present disclosure is related to the treatment of subterranean production intervals and, more particularly, to a reverse-out valve that minimizes swabbing of the formation caused by service tool manipulations during the well treatment operation.

The embodiments disclosed herein provide reverse-out valves used with a completion string and service tool. The reverse-out valves generally include a ball check and a reverse activated plug device arranged uphole therefrom. The ball check has a weeping feature used to allow a metered amount of fluid to bypass the ball check and thereby maintain hydrostatic pressure on the formation. This may be advantageous in preventing undesirable swabbing of a surrounding subterranean formation while moving the service tool upwards. The reverse activated plug device may be useful in substantially stopping the flow of circulation fluids to the ball check such that the pressure during reverse-out operations may be increased without adversely affecting the formation, which would otherwise receive an increased amount of metered fluid through the weeping feature of the ball check and potentially fracture the formation. Moreover, the service tool may be configured to automatically reset itself for reuse.

Figure 1:
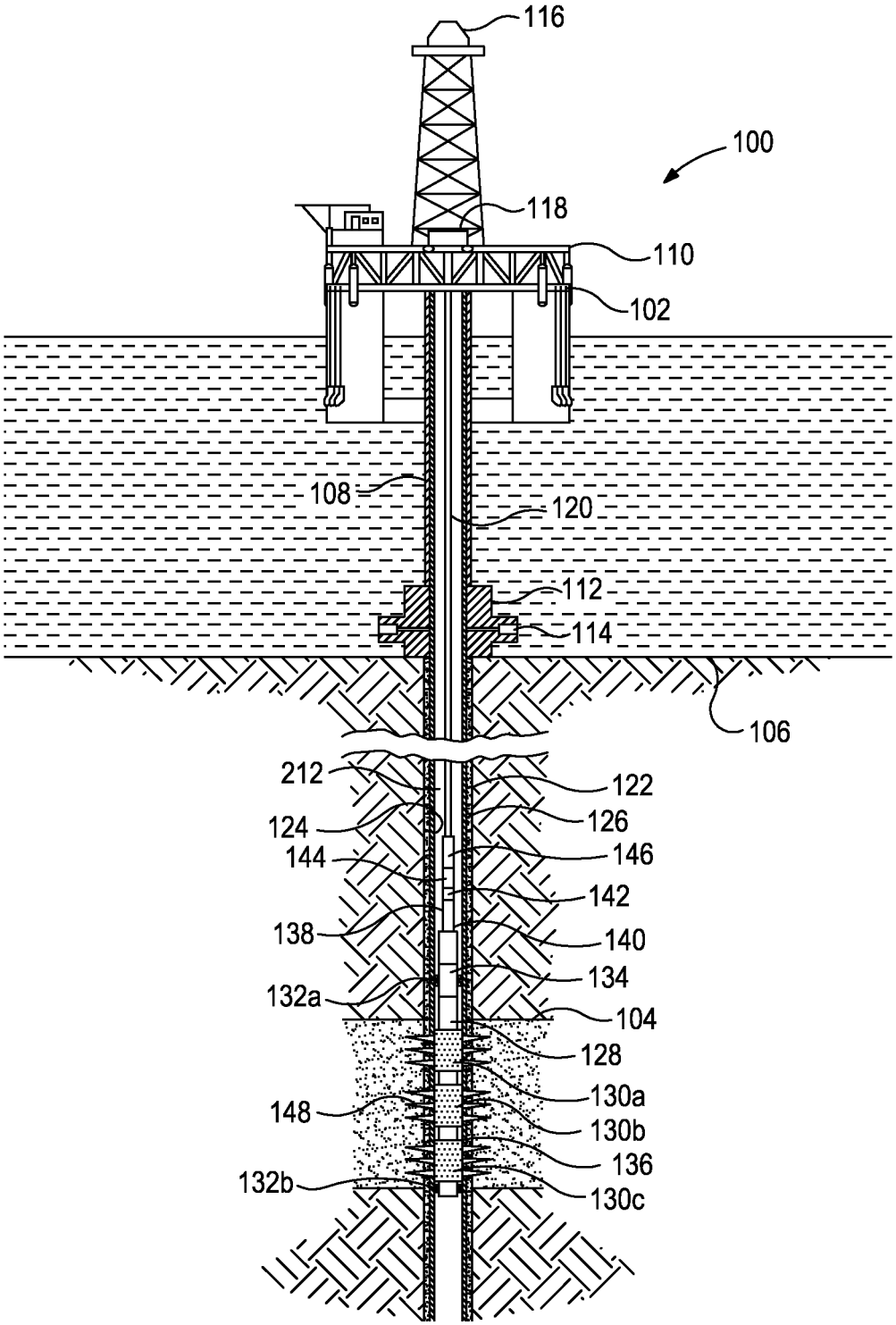
FIG. 1 illustrates an exemplary well system that employs one or more principles of the present disclosure, according to one or more embodiments.

Referring to FIG. 1, illustrated is an exemplary well system 100 that may employ one or more principles of the present disclosure, according to one or more embodiments. As illustrated, the well system 100 may include an offshore oil and gas platform 102 located above a submerged hydrocarbon-bearing formation 104 located below the sea floor 106. A subsea conduit or riser 108 extends from a deck 110 of the platform 102 to a wellhead installation 112 that may include one or more blowout preventers 114. The platform 102 may include a derrick 116 and a hoisting apparatus 118 for raising and lowering pipe strings, such as a work string 120. While the system 100 depicts the use of the offshore platform 102, it will be appreciated that the principles of the present disclosure are equally applicable to other types of oil and gas rigs, such as land-based drilling and production rigs, service rigs, and other oil and gas rigs located at any geographical location.

A wellbore 122 extends from the wellhead installation 112 and through various earth strata, including the formation 104. Casing 124 may be cemented within at least a portion of the wellbore 122 using cement 126. A completion string 128 is depicted in FIG. 1 as being installed within the casing 124 and may include one or more sand control devices, such as sand screens 130*a*, 130*b*, and 130*c* positioned adjacent the formation 104 between packers 132*a* and 132*b*. In some embodiments, the upper packer 132*a* may be part of a circulating valve 134.

When it is desired to gravel pack the annulus 136 defined about the sand control screens 130*a-c*, the work string 120 may be lowered through the casing 124 and at least partially into the completion string 128. The work string 120 may include a service tool 138 having a wash pipe 140, a reverse-out valve 142, a crossover tool 144, a setting tool 146, and other downhole tools known to those skilled in the art. Once the service tool 138 is properly positioned within completion string 128, the service tool 138 may be operated through its various positions to assure proper operation of the service tool 138. As illustrated, portions of the casing 124 and the wellbore 122 have been perforated to provide one or more perforations 148 that extend a distance into the surrounding formation 104 and provide fluid conductivity between the formation 104 and the annulus 136.

Even though FIG. 1 depicts a vertical well, it will be appreciated by those skilled in the art that the principles of the present disclosure are equally well-suited for use in deviated wells, inclined wells, or horizontal wells. Also, even though FIG. 1 depicts a cased wellbore 122, those skilled in the art will readily appreciate that the principles of the present disclosure are equally well-suited for use in open-hole completions. Additionally, even though FIG. 1 has been described with reference to a gravel packing operation, including a squeeze (i.e., fracking) operation, it should be noted by one skilled in the art that the principles of the present disclosure are equally well-suited for use in a variety of treatment operations where it is desirable to selectively allow and prevent circulation of fluids through a service tool 138 and prevent swabbing of the formation 104 due to axial movement of the service tool 138.

Figure 2:
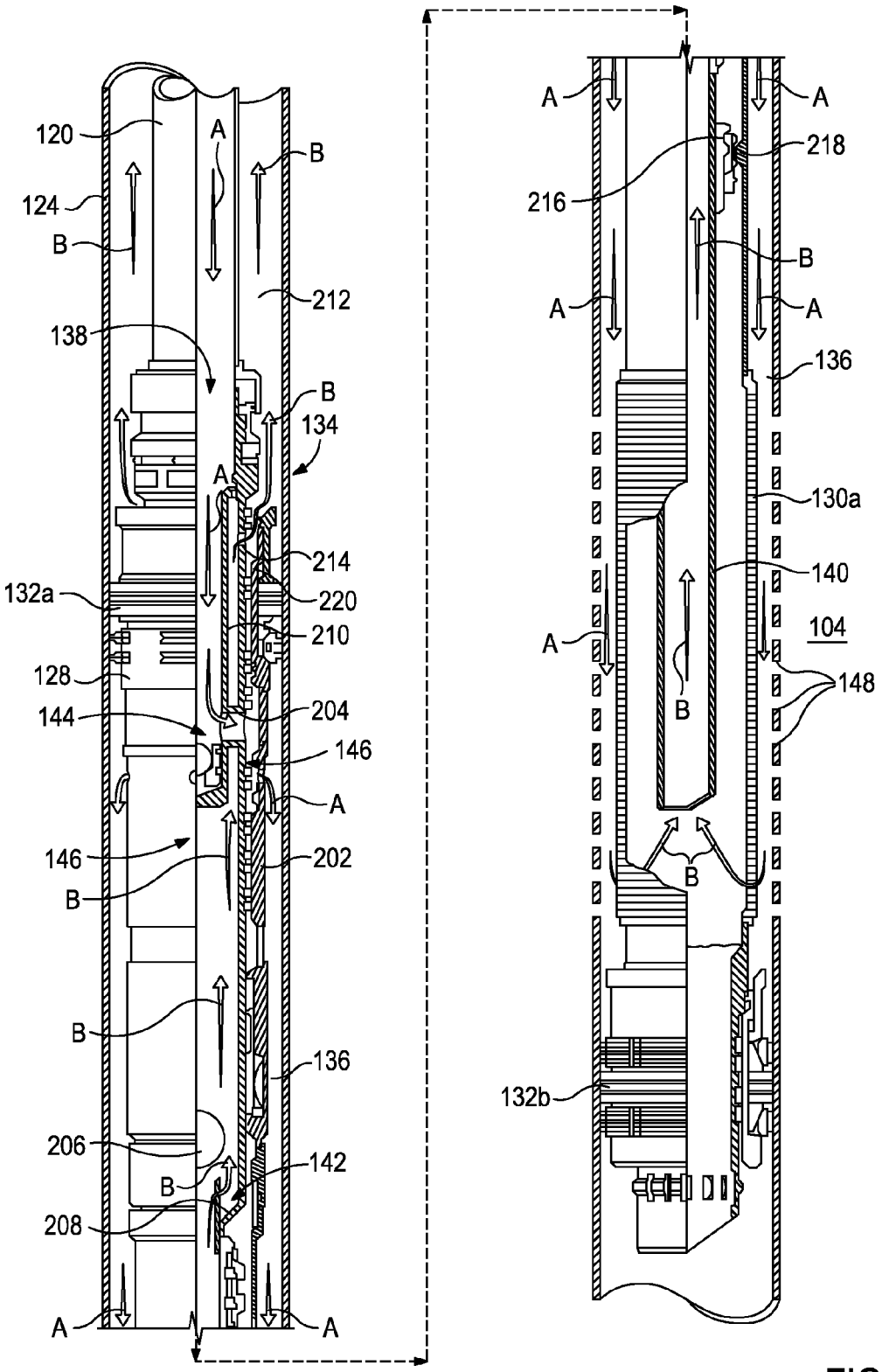
FIGS. 2-5 illustrate partial cross-sectional side views of the service tool of FIG. 1 positioned within the completion string of FIG. 1, according to one or more embodiments.
Figure 3:
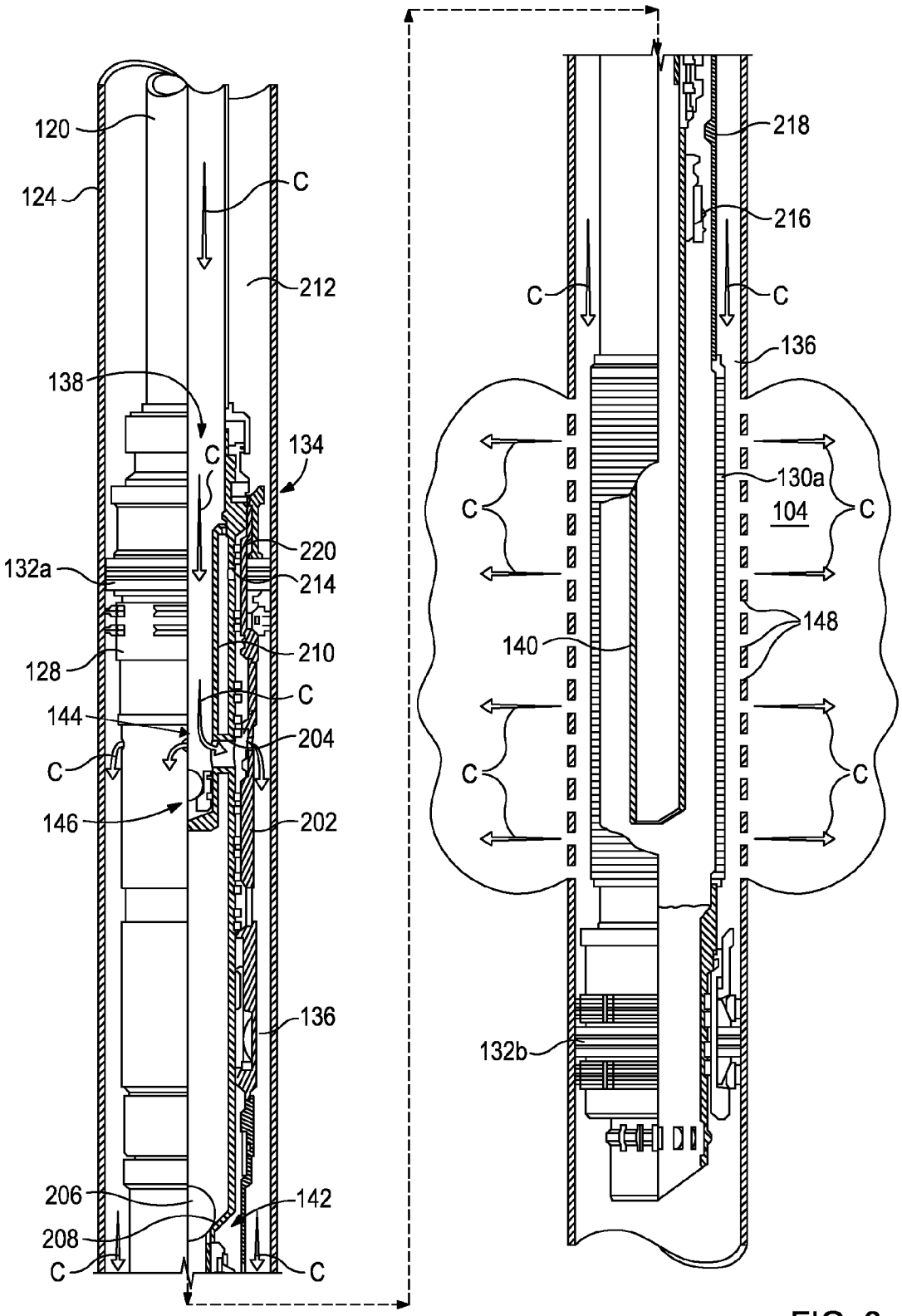
Figure 4:
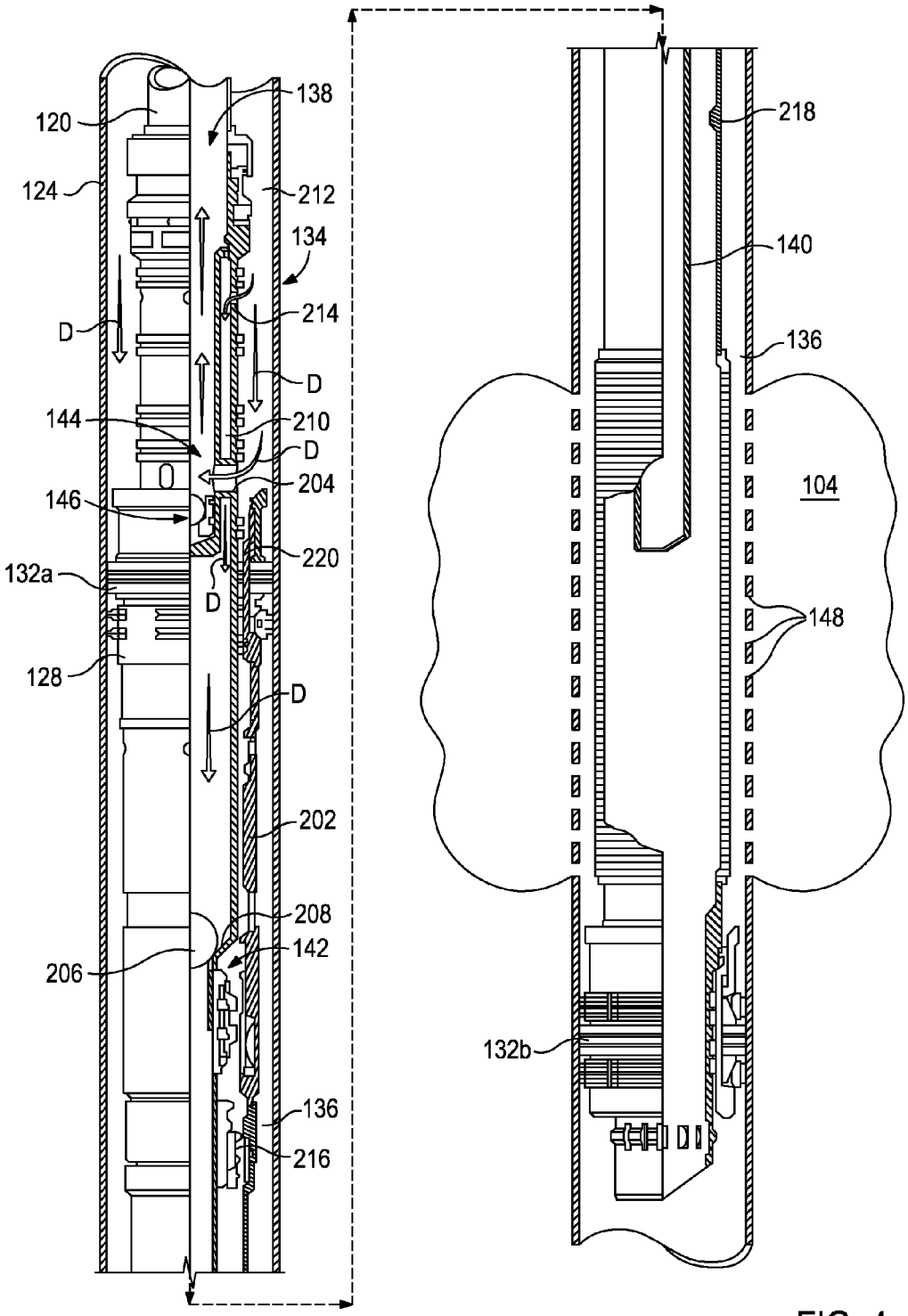
Figure 5:
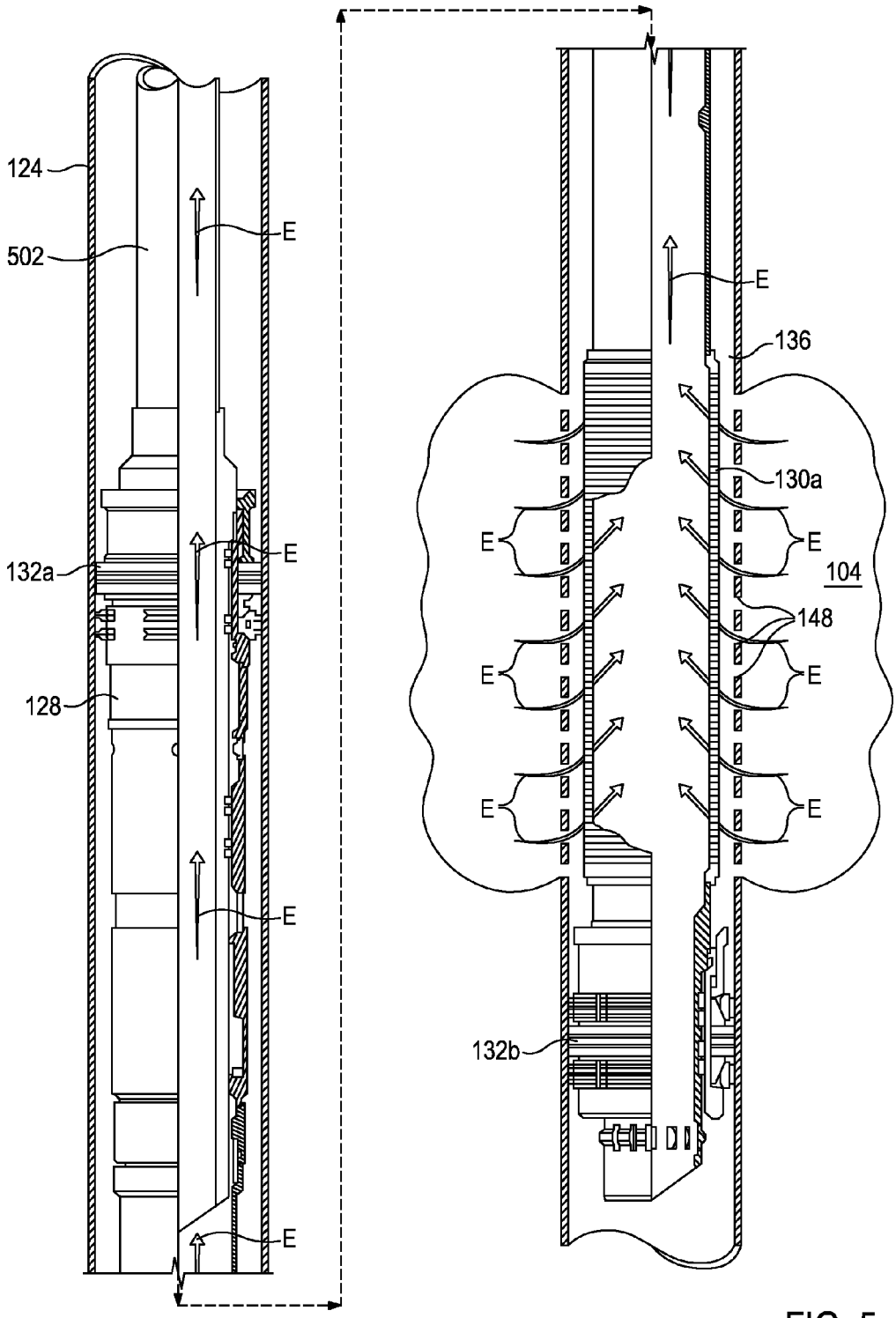

Referring now to FIGS. 2-5, with continued reference to FIG. 1, illustrated are partial cross-sectional side views of the service tool 138 positioned within the completion string 128, according to one or more embodiments. More particularly, FIGS. 2-5 depict successive axial sections of the service tool 138 and the completion string 128 while the service tool 138 is operated and otherwise axially manipulated relative to portions of the completion string 128. In FIG. 2, the service tool 138 is depicted in a circulating position, in FIG. 3 the service tool 138 is depicted in a squeeze position, and in FIG. 4 the service tool 138 is depicted in a reverse-out position. FIG. 5 depicts hydrocarbon production following removal of the service tool 138. It should be noted that only one sand screen 130*a* is depicted in FIGS. 2-5 for illustrative purposes in describing the features of the present disclosure. Those skilled in the art, however, will readily appreciate that more than one sand screen 130 (i.e., each of the sand screens 130*a-c* of FIG. 1) may be used, without departing from the scope of the disclosure.

Referring first to FIG. 2, a fluid slurry including a liquid carrier and a particulate material such as sand, gravel and/or proppants is pumped down the work string 120 to the service tool 138, as indicated by the arrows A, in order to undertake circulation operations. Once reaching the service tool 138, the fluid slurry A is able to exit the service tool 138 and enter the annulus 136 via the circulating valve 134. More particularly, a circulating sleeve 202 of the circulating valve 134 is depicted in its open position, thereby allowing the fluid slurry A to exit the crossover tool 144 via one or more circulation ports 204 provided by the crossover tool 144. As the fluid slurry A enters the annulus 136, at least a portion of the gravel in the fluid slurry is deposited within the annulus 136. Some of the liquid carrier and proppants, however, may enter the surrounding formation 104 through the one or more perforations 148 formed in the casing 124 and extending into the formation.

The remainder of the fluid carrier re-enters the service tool 138 via the sand control screen 130*a*, as indicated by arrows B. The fluid carrier B then enters the wash pipe 140 and is conveyed upward towards the reverse-out valve 142. As described in greater detail below, the reverse-out valve 142 may include a ball check 206 that, when the service tool 138 is in the circulating position, may be moved off a valve seat 208 such that the fluid carrier B may flow thereby and toward the crossover tool 144. At the crossover tool 144, the fluid carrier B may be conveyed to and through a return conduit 210 in fluid communication with the annulus 212 defined between the work string 120 and the wellbore 122 (FIG. 1) above the upper packer 132*a* via one or more return ports 214. After flowing out of the completion string 128 via the return ports 214, the fluid carrier B may return to the surface via the annulus 212. In the circulation position, the fluid slurry A is continuously pumped down the work string 120 until the annulus 136 around the sand control screen 130*a* is sufficiently filled with gravel, and the fluid carrier B is continuously returned to the surface via the annulus 212 for rehabilitation and recycling.

In FIG. 3, the service tool 138 has been moved axially with respect to the completion string 128 to the squeeze position. This may be accomplished by disengaging a weight down collet 216 from an indicator collar 218 defined on the inner surface of the completion string 128 and thereafter axially moving the service tool 138 relative to the completion string 128 until a seal 220 of the completion string 128 occludes the return ports 214. In the illustrated embodiment, the service tool 138 has been moved axially downwards in order to occlude the return ports 214 by placing a seal 220 inside the packer.

Once the service tool 138 is properly placed in the squeeze position, additional fluid slurry or another treatment fluid may then be pumped down the work string 120 and to the service tool, as indicated by the arrows C. Once in the service tool 138, the fluid slurry C may again pass through the crossover tool 144 and the circulating valve 134 via the circulation ports 204 and finally into the annulus 136 where the fluid slurry C enters the perforations 148 and serves to hydraulically fracture the formation 104. Since the return ports 214 are occluded by the seal 220 inside the packer mandrel, no return fluids enter the wash pipe 140 and flow towards the reverse-out valve 142. As a result, the ball check 206 is able to sit idly against the valve seat 208 using, for instance, gravitational forces acting thereon.

In FIG. 4, the service tool 138 has been moved into the reverse-out position to once again allow fluid returns to the surface. To accomplish this, the work string 120 and the service tool 138 are moved upwards with respect to the completion string 128, thereby exposing the return ports 214 and the circulation ports 204 to the annulus 212. In this configuration, a completion fluid may be pumped down the annulus 212 and into the service tool 138 through the crossover tool 144, as indicated by the arrows D. The completion fluid D flows into the work string 120 and returns to the surface via the work string 120 in order to reverse-out any gravel, proppant, or fluids that may remain within the work string 120.

During this process, a portion of the completion fluid D may also fluidly communicate with the reverse-out valve 142. More particularly, a portion of the completion fluid may enter the return conduit 210 via the return ports 214 and be conveyed toward the reverse-out valve 142 via the crossover tool 144. The fluid pressure exhibited by the completion fluid D forces the ball check 206 to seal against the valve seat 208, thereby creating a hard bottom that prevents the completion fluid D from traveling further downhole past the reverse-out valve 142. As will be discussed below, however, the ball check 206 may be configured to allow a metered amount of completion fluid D to pass therethrough in order to maintain hydrostatic pressure on the formation 104 via the wash pipe 140 and the sand screen 130*a*. As will be appreciated, allowing a metered amount of completion fluid D to pass through the reverse-out valve 142 prevents swabbing of the formation 104 even if the reverse-out valve 142 is moved upwardly relative to the completion string 128.

In FIG. 5, the service tool 138 has been removed from the completion string 128 and returned to the surface. In its place, production tubing 502 has been stung into and otherwise operatively coupled to the completion string 128. At this point, hydrocarbons may be produced from the formation 104, through the sand screen 130*a*, and conveyed to the surface via the production tubing 502, as indicated by arrows E.

Figure 6A:
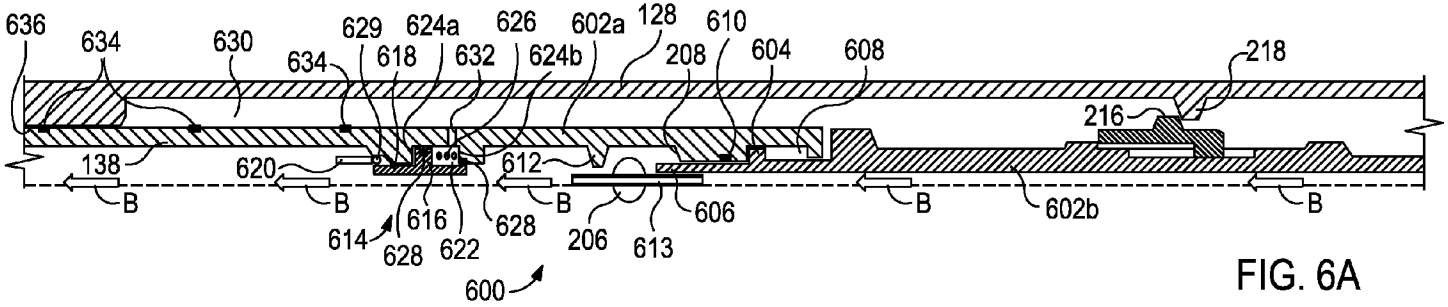
FIGS. 6A-6C illustrate progressive cross-sectional views of an exemplary reverse-out valve, according to one or more embodiments.
Figure 6B:
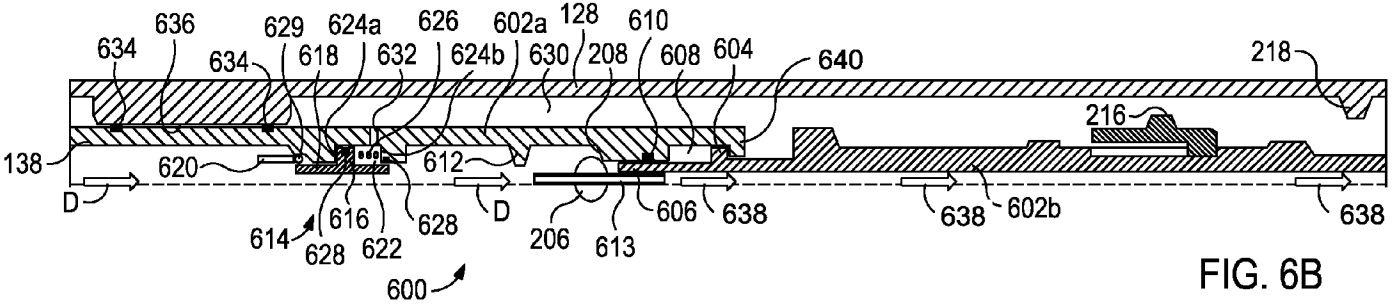
Figure 6C:
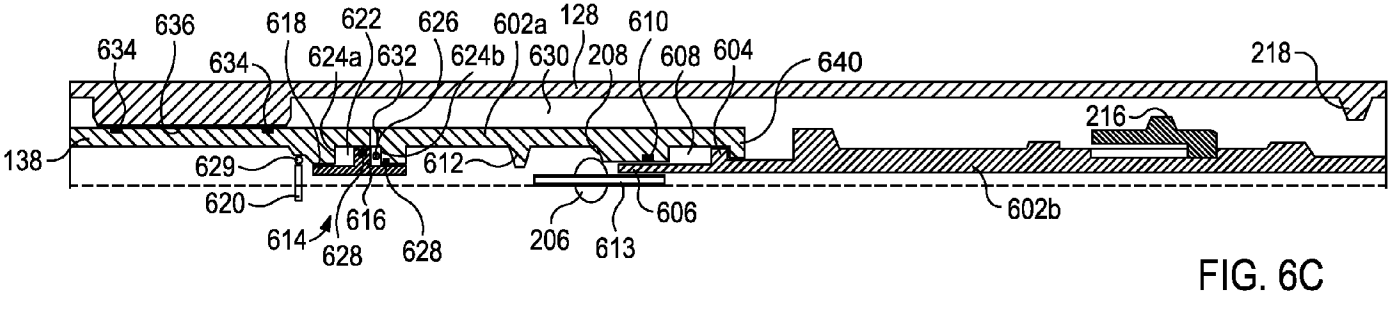

Referring now to FIGS. 6A-6C, illustrated are progressive cross-sectional views of an exemplary reverse-out valve 600, according to one or more embodiments. The reverse-out valve 600 may be similar in some respects to the reverse-out valve 142 of FIGS. 1-5, and may otherwise replace the reverse-out valve 142 during the circulation, squeeze, and reverse-out operations generally described above. Similar reference numerals used in FIGS. 6A-6C from prior figures indicate like elements that will not be described again in detail. In FIGS. 6A-6C, the reverse-out valve 600 forms part of the service tool 138 and is otherwise arranged within the completion string 128. FIG. 6A shows the reverse-out valve 600 during a circulation operation, FIG. 6B shows the reverse-out valve 600 while the service tool 138 is being moved to the reverse-out position and/or at the reverse-out position, and FIG. 6C shows the reverse-out valve 600 during a reverse-out operation.

As illustrated, the reverse-out valve 600 may include an upper mandrel 602*a* and a lower mandrel 602*b*. The weight down collet 216 may be arranged on the lower mandrel 602*b* and configured to axially support the service tool 138 when engaged with the indicator collar 218 defined on the inner wall of the completion string 128. The lower mandrel 602*b* may further include a radial shoulder 604 and a stem 606 that extends longitudinally upward from the radial shoulder 604. The upper mandrel 602*a* may define or otherwise provide an axial chamber 608 configured to receive the radial shoulder 604 of the lower mandrel 602*b* therein. The radial shoulder 604 may be able to axially translate within the axial chamber 608, and the interface between the upper and lower mandrels 602*a,b* may be sealed using one or more sealing elements 610 (one shown).

The ball check 206 may be generally arranged within the service tool 138 between a radial protrusion 612 defined on the inner wall of the service tool 138 and the valve seat 208. In some embodiments, the radial protrusion 612 may be castellated or otherwise include one or more flow paths used to allow fluid flow therethrough but simultaneously prevent the ball check 206 from moving past it. During weight-down on the service tool 138, such as is shown in FIG. 6A, the radial shoulder 604 may be arranged at the uphole end of the axial chamber 608, thereby extending the stem 606 past the valve seat 208 and otherwise separating the ball check 206 from the valve seat 208.

The ball check 206 may be ported or otherwise provide an axial fluid passageway 613. In some embodiments, the axial fluid passageway 613 may be a tubular structure known as a "weep tube" that extends through the ball check 206. In other embodiments, however, the axial fluid passageway 613 may be an orifice defined in the ball check valve 206 without departing from the scope of the disclosure. As will be described below, the fluid passageway 613 may be configured to allow a metered portion of fluid to pass therethrough in order to maintain hydrostatic pressure on the formation 104 (FIGS. 1-5) as the service tool 138 is moved within the completion string 128. Advantageously, fluid flow through the fluid passageway 613 may help mitigate or otherwise prevent damage to the formation 104 due to swabbing.

The reverse-out valve 600 may further include a reverse activated plug device 614 arranged uphole from the ball check 206. In the illustrated embodiment, the reverse activated plug device 614 may include a piston 616, a prop 618 extending longitudinally upward from the piston 616, and a flapper 620. The piston 616 may be movably arranged within a piston chamber 622 defined or otherwise provided by the upper mandrel 602*a*. The piston chamber 622 may include a first or upper end 624*a* and a second or lower end 624*b*. A biasing device 626, such as a helical compression spring or the like, may be arranged between the piston 616 and the lower end 624*b* of the piston chamber 622. The biasing device 626 may be configured to urge the piston 616 toward the upper end 624*a* of the piston chamber 622.

One or more sealing devices 628 may interpose the piston 616 and the piston chamber 622 and/or the upper mandrel 602*a* such that a sealed interface results as the piston 616 axially translates within the piston chamber 622. One or more ports 632 (one shown) may be defined in the upper mandrel 602*a* in order to place the piston chamber 622 in fluid communication with an annulus 630 defined between the completion string 128 and the service tool 138. The annulus 630 may fluidly communicate with the annulus 136 (FIGS. 2-5) defined between the sand screen 130*a* and the casing 124 (FIGS. 2-5) or the formation 104 (FIGS. 2-5). As a result, the annulus 630 may generally exhibit the same fluid pressure as the annulus 136, and such fluid pressure may be exhibited within the piston chamber 622 via the ports 632.

When the piston 616 is generally arranged at the first end 624*a* of the piston chamber 622, as shown in FIGS. 6A and 6B, the prop 618 may be configured to hold the flapper 620 in an open position. The flapper 620 may include a torsion spring 629 or the like that urges the flapper 620 toward a closed position (FIG. 6C) when not engaged or otherwise prevented from closing by the prop 618.

In FIG. 6A, the completion string 128 and the service tool 138 are in the circulation position, as generally described above with reference to FIG. 2, and the reverse activated plug device 614 is in an open position. As described above with reference to FIG. 2, some of the liquid carrier or fluid B from the fluid slurry provided to the service tool 138 may re-enter the service tool 138 at the sand screens (not shown) and be conveyed toward the reverse-out valve 142. In FIG. 6A, the fluid B is able to flow past the ball check 206, which is held off the valve seat 208 with the stem 606.

Moreover, during circulation the reverse activated plug device 614 may also be held in an open position. More particularly, the fluid pressure within the service tool 138 and the annulus 630 is generally balanced during circulation operations, thereby allowing the biasing device 622 to urge the piston 616 against the first end 624*a* of the piston chamber 622 as designed. As a result, the flapper 620 is propped open by the prop 618, and thereby holds the reverse activated plug device 614 in the open position and allows the fluid B to bypass the reverse activated plug device 614 and proceed upward within the service tool 138.

In FIG. 6B, the service tool 138 is either being moved uphole or "picked up" in the upwards direction with respect to the completion string 128 or is otherwise arranged for reverse-out operations. As the service tool 138 is moved uphole, one or more sealing elements 634 provided on the upper mandrel 602*a* may be moved into sealing engagement with a seal bore 636 of the completion string 128. As will be appreciated, the sealing elements 634 may equally be arranged on the seal bore 636, without departing from the scope of the disclosure. Moreover, as the service tool 138 is moved uphole, the radial shoulder 604 of the lower mandrel 602*b* engages an end wall 640 provided on the lower end of the axial chamber 608 and thereby separates the weight down collet 216 from the indicator collar 218. Engaging the radial shoulder on the end wall 640 also lowers the stem 606 with respect to the valve seat 208, thereby allowing the ball check 206 to engage the valve seat 208.

As the service tool 138 is moved uphole, a portion of the fluid 638 within the service tool 138 may be able to traverse the ball check 206 through the fluid passageway 613 and flow toward the formation 104 (FIGS. 1-5). As can be appreciated, some wells that are being gravel packed do not exhibit large amounts of pressure and the corresponding formations 104 are oftentimes lightly consolidated. As a result, well operators must maintain fluid pressure on the formation 104 at all times or otherwise risk damage to the integrity of the formation 104. Advantageously, the fluid passageway 613 allows the formation 104 to receive or eject fluids 638 through the ball check 206 when needed in order to maintain the integrity of the formation 104. Without the fluid passageway 613, a vacuum or overpressure could result at or near the formation 104 when the service tool 138 is moved axially, thereby potentially resulting in significant damage to the formation 104, including undesirable swabbing thereof.

Accordingly, the service tool 138 and corresponding reverse-out valve 600 can be moved upwardly or downwardly within the completion string 128 as many times as desired by the well operator, depending upon the desired treatment regimen. Importantly, this upward and downward movement will not cause swabbing of the formation 104 as the fluids are able to bypass the ball check 206 at a metered flow rate via the fluid passageway 613.

As the service tool 138 is moved with respect to the completion string 128, the reverse activated plug device 614 remains in its open position. During such movement, the fluid pressure within the service tool 138 may exceed that of the annulus 630, but the biasing device 626 may be configured to urge the piston 616 against the first end 624*a* of the piston chamber 622 until a predetermined pressure threshold is attained. More particularly, the biasing device 626 may be sized or otherwise rated so that the piston 616 will be unable to move toward the second end 624*b* and thereby compress the biasing device 626 until a predetermined pressure differential between the interior of the service tool 138 and the annulus 630 is achieved. Once the predetermined pressure differential is achieved, however, the piston 616 is able to compress the biasing device 626 and move toward the second end 624*b* of the piston chamber 622.

Still referring to FIG. 6B, once the service tool 138 is properly positioned for reverse-out operations, the completion fluid D may be introduced into the service tool 138 in order to reverse-out any gravel, proppant, or fluids remaining within the work string 120, as generally described above with reference to FIG. 4. A portion of the completion fluid D may interact with the reverse-out valve 600, and the resulting fluid pressure forces the ball check 206 to seal against the valve seat 208, thereby creating a hard bottom that largely prevents the completion fluid D from traveling further downhole. As the ball check 206 seals against the valve seat 208, a metered amount of the fluid 638 is able to flow through the fluid passageway 613 to maintain hydrostatic pressure on the formation 104. As the fluid pressure of the completion fluid D increases, the weep rate or flow rate of the fluid 638 through the fluid passageway 613 correspondingly increases. As will be appreciated, the size (i.e., diameter) and length of the fluid passageway 613 may be optimized in order to alter the flow rate through the fluid passageway 613 and otherwise provide a required or desired amount of fluid 638 to the formation 104 while moving the service tool 138 and to restrict the amount of fluid to the formation 104 during reverse out.

In FIG. 6C, the pressure of the completion fluid D has increased to or past the pressure threshold or to a point where the predetermined pressure differential between the interior of the service tool 138 and the annulus 630 has been reached. As a result, the reverse activated plug device 614 may be actuated. More particularly, the pressure differential may overcome the spring force of the biasing device 626, thereby allowing the piston 616 to compress the biasing device 626 as it moves toward the second end 624*b*.

As the piston 616 moves to the second end 624*b* of the piston chamber 622, the prop 618 moves out of radial engagement with the flapper 620, thereby allowing the torsion spring 629 to pivot the flapper 620 to its closed position. With the reverse activated plug device 614 in its closed position, the reverse-out fluid pressures within the service tool 138 can be maxed out for greatest reverse-circulation effectiveness. More specifically, the completion fluid D (FIG. 6B) will be unable to bypass the reverse activated plug device 614 in the closed position, thereby preventing increased-pressure fluids from potentially bypassing the ball check 206 via the fluid passageway 613 and potentially damaging the formation 104 (FIGS. 1-5). The elevated fluid pressures within the service tool 138 may be configured to maintain the flapper 620 closed and isolate the formation 104 from the increased reverse-out pressures. The flapper 620 may be configured to reopen when the pressure within the service tool 138 once again falls below the predetermined pressure threshold or differential, which causes the biasing device 626 to again urge the piston 616 back toward the first end 624*a* and the prop 618 to force the flapper 620 back to its open configuration. Moving the service tool 138 down towards the circulating position will cause the fluid pressure inside the service tool 138 below the reverse activated plug device 614 to increase back to equal pressure above and below the flapper and allowing the prop to reopen the flapper.

As will be appreciated, the addition of the reverse activated plug device 614 eliminates the potential for pressurized fluid 638 (FIG. 6B) to reach the formation 104 (FIGS. 1-5) during reverse-out operations. Advantageously, the internal pressure of the service tool 138 autonomously shuts off any potential fluid flow further down the service tool 138, such as to the ball check 206 or to the formation 104. During treating, the service tool 138 is in a fully open configuration to communicate fluid with the annulus 212. While moving the service tool 138, the fluid passageway 613 helps to maintain hydrostatic pressure on the formation 104 while also preventing swabbing. Moreover, the service tool 138 may be configured to automatically reset itself for reuse.

Those skilled in the art will readily appreciate that variations of the reverse activated plug device 614 may be used in the reverse-out valve 600, without departing from the scope of the disclosure. For example, it is further contemplated herein to replace the flapper 620 with at least one of a) a ball that seals against a ball seat, b) a ported shoulder that seals against a corresponding seal surface defined on the upper mandrel 602*a*, and c) a ported shoulder having a sealing element configured to engage the inner wall of the upper mandrel 602*a*. In each of these additional embodiments, as the piston 616 moves to the second end 624*b* of the piston chamber 622, the prop 618 correspondingly moves and allows a) the ball to seal against the ball seat, b) the ported shoulder to sealingly engage the seal surface, or c) the sealing element of the ported shoulder to sealing engage the inner wall of the upper mandrel 602*a*. As a result, in any of the above-described additional embodiments, the reverse activated plug device 614 is moved to its closed position, thereby substantially preventing the completion fluid D (FIG. 6B) to bypass the reverse activated plug device 614 and preventing increased-pressure fluids from potentially bypassing the ball check 206 via the fluid passageway 613 and potentially damaging the formation 104 (FIGS. 1-5). Moreover, in any of the above-described additional embodiments, the reverse activated plug device 614 may be reopened when the pressure within the service tool 138 once again falls below the predetermined pressure threshold or differential.

Figure 7A:
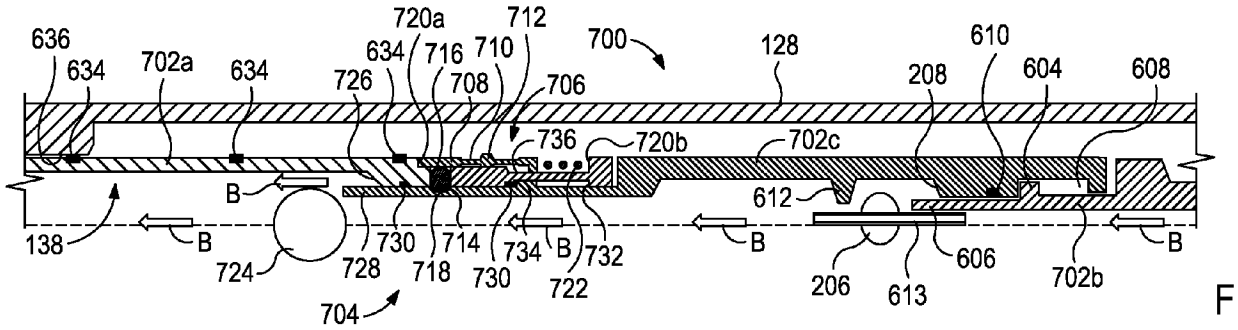
FIGS. 7A-7C illustrate progressive cross-sectional views of another exemplary reverse-out valve, according to one or more embodiments.
Figure 7B:
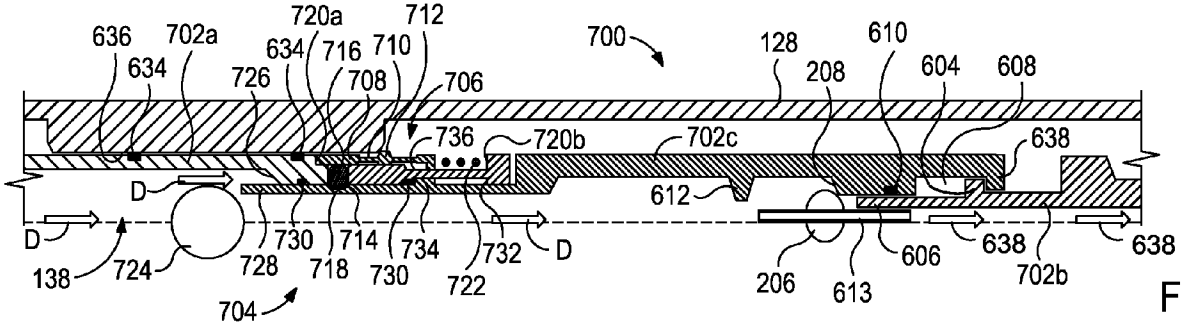
Figure 7C:
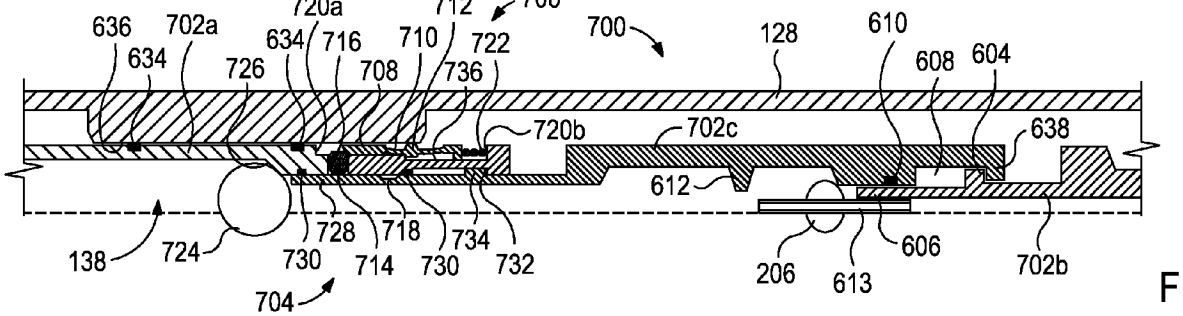

Referring now to FIGS. 7A-7C, illustrated are progressive cross-sectional views of another exemplary reverse-out valve 700, according to one or more embodiments. The reverse-out valve 700 may be similar in some respects to the reverse-out valve 600 of FIGS. 6A-6C and therefore may be best understood with reference thereto, where like numerals indicate like elements not described again in detail. Similar to the reverse-out valve 600 of FIGS. 6A-6C, the reverse-out valve 700 may replace the reverse-out valve 142 of FIGS. 1-5 during the circulation, squeeze, and reverse-out operations generally described above. The reverse-out valve 700 again forms part of the service tool 138 and is otherwise arranged within the completion string 128. FIG. 7A shows the reverse-out valve 700 during circulation operations, FIG. 7B shows the reverse-out valve 700 while the service tool 138 is being moved to the reverse-out position and/or positioned at the reverse-out position, and FIG. 7C shows the reverse-out valve 700 during reverse-out operations.

As illustrated, the reverse-out valve 700 may include an upper mandrel 702*a*, a lower mandrel 702*b*, and an intermediate mandrel 702*c* that interposes the upper and lower mandrels 702*a,b*. The intermediate and lower mandrels 702*c* and 702*b* may be similar in some respects to the upper and lower mandrels 602*a,b*, respectively, of FIGS. 6A-6C. More particularly, the lower mandrel 702*b* may include or otherwise provide the radial shoulder 604 and the stem 606, and the intermediate mandrel 702*c* may define or otherwise provide the axial chamber 608 configured to receive the radial shoulder 604. Moreover, the intermediate mandrel 702*c* may further provide the valve seat 208 and the radial protrusion 612 defined on the inner wall of the service tool 138.

The reverse-out valve 700 may include the ball check 206, which operates in substantially the same way as described above with reference to the reverse-out valve 600. Again, the ball check 206 may include or otherwise have defined therein the fluid passageway 613 used to maintain hydrostatic pressure on the formation 104 (FIGS. 1-5) as the service tool 138 is moved within the completion string 128, and thereby preventing undesirable swabbing of the formation 104.

The reverse-out valve 700 may further include a reverse activated plug device 704 arranged uphole from the ball check 206. Similar to the reverse activated plug device 614 of FIGS. 6A-6C, the reverse activated plug device 704 may be configured to eliminate the potential for pressurized fluid to reach the formation 104 (FIGS. 1-5) during full reverse-out operations and otherwise shut off any potential fluid flow further down the service tool 138, such as to the ball check 206. As illustrated, the reverse activated plug device 704 may include a collet 706 having a cover portion 708 and a plurality of fingers 710 (one shown) extending axially from the cover portion 708. The collet 706 may be generally arranged about the upper mandrel 702*a* and each finger 710 may include or otherwise have defined thereon a collet protrusion 712.

The reverse activated plug device 704 may further include a plurality of dogs 714 movably arranged within a corresponding plurality of windows 716 defined in the upper mandrel 702*a*. Similar to the reverse activated plug device 614 of FIGS. 6A-6C, the reverse activated plug device 704 may be movable between an open position and a closed position. In the open position, as shown in FIGS. 7A and 7B, the dogs 714 may be disposed within a groove 718 defined in the intermediate mandrel 702*c* and may be maintained therein with the cover portion 708 being extended radially over each window 716. More specifically, in the open position, the cover portion 708 may be urged against or toward an upper shoulder 720*a* of the upper mandrel 702*a* with a biasing device 722, and thereby be moved over the windows 716 and otherwise prevent the dogs 714 from exiting the groove 718. The biasing device 722 may be a helical compression spring or the like and may be arranged between the collet 706 and a lower shoulder 720*b* of the upper mandrel 702*a*.

The reverse activated plug device 704 may further include a plug device ball 724 and a plug seat 726 defined on the interior of the upper mandrel 702*a*. The plug device ball 724 may be configured to engage or otherwise seal against the plug seat 726 when not obstructed by a proximal end 728 of the intermediate mandrel 702*c*. Once the intermediate mandrel 702*c* moves axially downward with respect to the upper mandrel 702*a*, as shown in FIG. 7C, the proximal end 728 exposes the plug seat 726 and thereby allows the plug device ball 724 to engage and seal against the plug seat 726. One or more sealing elements 730 may interpose the upper and intermediate mandrels 702*a,c* such that a sealed interface results as the reverse activated plug device 704 moves between the open and closed positions.

In FIG. 7A, the completion string 128 and the service tool 138 are in the circulation position, as generally described above with reference to FIG. 2, and the reverse activated plug device 704 is in its open position. Some of the liquid carrier or fluid B from the fluid slurry provided to the service tool 138 re-enters the service tool 138 and is conveyed toward the reverse-out valve 700, as generally described above. In FIG. 7A, the fluid B is able to flow past the ball check 206, which is held off the valve seat 208 with the stem 606. The fluid B is also able to flow past the plug device ball 724 of the reverse activated plug device 704, which is also held in its open position by the dogs 714 being arranged in the groove 718 and held in place by the cover 708 such that the proximal end 728 of the intermediate mandrel 702*c* extends upwards past the plug seat 726.

In FIG. 7B, the service tool 138 is depicted as being moved in the upwards direction (i.e., uphole) with respect to the completion string 128 or otherwise in a partial reverse-out position. As the service tool 138 is moved uphole, the sealing elements 634 provided on the upper mandrel 702*a* may be moved into sealing engagement with the seal bore 636 of the completion string 128. Moreover, as the service tool 138 is moved uphole, the radial shoulder 604 of the lower mandrel 602*b* engages the end wall 640 of the axial chamber 608, thereby lowering the stem 606 with respect to the valve seat 208 and allowing the ball check 206 to engage and seal against the valve seat 208.

Moreover, as the service tool 138 is moved uphole, or otherwise while the service tool 138 is in the partial reverse-out position, the collet protrusions 712 of the reverse activated plug device 704 will eventually engage the seal bore 636. In such a configuration, reverse-out operations may commence by introducing the completion fluid D into the service tool 138 in order to reverse-out any gravel, proppant, or fluids remaining within the work string 120, as generally described above with reference to FIG. 4. Some completion fluid D may flow around the plug device ball 724 of the reverse activated plug device 704, which is held in its open position by the proximal end 728 of the intermediate mandrel 702*c*. It should be noted that the proximal end 728 may be castellated or otherwise have one or more flow channels (not shown) defined therein such that the completion fluid D may flow therethrough when the plug device ball 724 is forced against it. Accordingly, a portion of the fluid D within the service tool 138 may be able to bypass the plug device ball 724 and subsequently traverse the ball check 206 via the fluid passageway 613 as fluid 638.

The completion fluid D that bypasses the plug device ball 724 may force the ball check 206 to seal against the valve seat 208, thereby creating a hard bottom that largely prevents the completion fluid D from traveling further downhole. As described above, the ball check 206 seals against the valve seat 208, but a metered amount of the fluid 638 is able to flow through the fluid passageway 613 to maintain hydrostatic pressure on the formation 104. Again, the fluid passageway 613 allows the formation 104 (FIGS. 1-5) to receive or eject fluids 638 through the ball check 206 when needed in order to maintain the integrity of the formation 104 and prevent undesirable swabbing thereof.

Referring to FIG. 7C, the service tool 138 is shown as fully actuated to a full reverse-out position, where the reverse activated plug device 704 is placed in its closed position. More particularly, once the collet protrusions 712 engage the seal bore 636, the upper mandrel 702*a* may be able to continue moving upward, thereby compressing the biasing device 722 between the lower shoulder 720*b* and the collet 706. With the dogs 714 generally arranged within the groove 718, the upper mandrel 702*a* is prevented from moving with respect to the intermediate mandrel 702*c*. As the biasing device 722 is compressed, however, the cover portion 708 may be moved out of axial engagement with the upper shoulder 720*a* and therefore out of radial engagement with the dogs 714. As a result, the dogs 714 may then be able to radially expand within their respective windows 716 and otherwise release the upper mandrel 702*a* with respect to the intermediate mandrel 702*c*. Beveled or chamfered edges of the dogs 714 and/or the groove 718 may help facilitate ease of radial movement of the dogs 714 out of the groove 718.

Once the biasing device 722 is compressed fully and otherwise bottoms out against the lower shoulder 720*b*, the upper mandrel 702*a* may continue to move upward and an end wall 732 of the upper mandrel 702*a* may be brought into axial contact with a radial protrusion 734 of the intermediate mandrel 702*c*. Once the end wall 732 and the radial protrusion 734 are axially engaged, continued axial force applied on the upper mandrel 702*a* may force the collet protrusions 712 to flex radially inward and into a reduced-diameter portion 736 defined in the upper mandrel 702*a* between the upper and lower shoulders 720*a,b*. Beveled or chamfered edges or ends of one or more of the collet protrusions 712, the seal bore 636, and the reduced-diameter portion 736 may help facilitate ease of radial movement of the collet protrusions 712 into the reduced-diameter portion 736. Once flexed into the reduced-diameter portion 736, the collet protrusions 712 may be able to slide or move beneath the seal bore 636 as the service tool 138 continues moving upward.

With the reverse activated plug device 704 placed in its closed position, the proximal end 728 of the intermediate mandrel 702*c* is moved axially downward, thereby allowing the plug device ball 724 to engage and seal against the plug seat 726. In this position, the reverse-out fluid pressures within the service tool 138 may be maxed out for greatest reverse-circulation effectiveness. More specifically, with the plug device ball 724 sealingly engaged with the plug seat 726, the completion fluid D (FIG. 7B) will be unable to bypass the reverse activated plug device 704, thereby isolating the formation 104 and otherwise preventing increased-pressure fluids from bypassing the ball check 206 via the fluid passageway 613 and potentially damaging the formation 104 (FIGS. 1-5).

The reverse activated plug device 704 may be moved back to its open position by placing an axial compression load on the upper mandrel 702*a*, which will separate the end wall 732 and the radial protrusion 734 and otherwise allow the dogs 714 to seat themselves again within the groove 718. The proximal end 728 of the intermediate mandrel 702*c* also extends back upwards, thereby forcing the plug device ball 724 off the plug seat 726. Continued axial compression load may move the collet protrusions 712 out of radial engagement with the seal bore 636, thereby allowing the spring force built up in the biasing device 722 to urge the collet 706 back against the upper shoulder 720*a*. In this position, the cover portion 708 once again extends over the windows 716 and thereby maintains the dogs 714 within the groove 718.

Figure 8A:
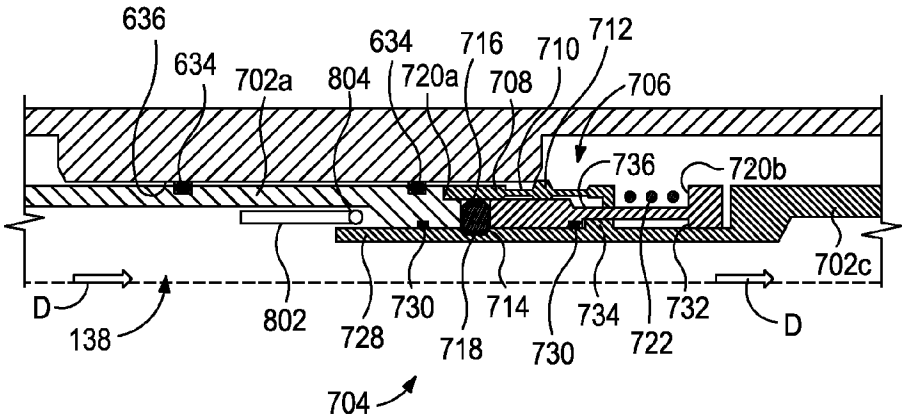
FIGS. 8A-8C illustrate cross-sectional view of alternative embodiments of the reverse activated plug device of FIGS. 6A-6C, according to one or more embodiments.
Figure 8B:
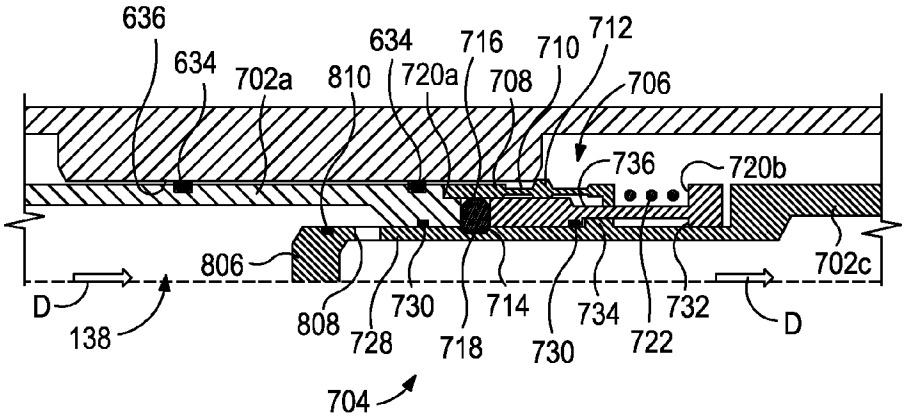
Figure 8C:
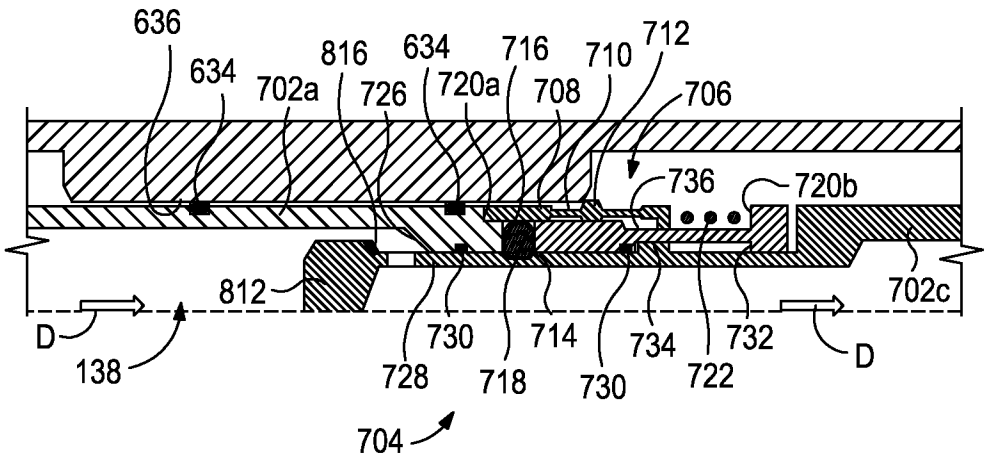

Those skilled in the art will readily appreciate that variations of the reverse activated plug device 704 may be used in the reverse-out valve 700, without departing from the scope of the disclosure. For example, referring now to FIGS. 8A-8C, illustrated are alternative embodiments of the reverse activated plug device 704 of FIGS. 7A-7C, according to one or more embodiments. In each of FIGS. 8A-8C, the plug device ball 724 of FIGS. 7A-7C is replaced with another mechanism or device configured to provide a sealed or plugged location within the service tool 138 such that the completion fluid D will be unable to bypass the reverse activated plug device 704. The reverse activated plug device 704 in each of these embodiments may be re-opened by applying an axial compression load on the service tool 138, as generally described above.

In FIG. 8A, the reverse activated plug device 704 may include a flapper 802 that is held in the open position by the proximal end 728 of the intermediate mandrel 702*c*. The flapper 802 may include a torsion spring 804 or the like that urges the flapper 802 toward a closed position when not engaged or otherwise prevented from closing by the proximal end 728. In operation, the upper mandrel 702*a* is picked upwards, thereby forcing the collet protrusions 712 against the seal bore 636 and eventually into the reduced-diameter portion 736 defined in the upper mandrel 702*a* between the upper and lower shoulders 720*a,b*, as generally described above. During this process, the dogs 714 are able to radially expand and release the upper mandrel 702*a*, thereby allowing the proximal end 728 of the intermediate mandrel 702*c* to move axially downward and simultaneously allowing the torsion spring 804 to pivot the flapper 802 to its closed position.

In FIG. 8B, the reverse activated plug device 704 may include a ported end 806 extending from or otherwise forming part of the proximal end 728 of the intermediate mandrel 702*c*. The ported end 806 may include a one or more flow ports 808 (one shown) and a sealing element 810. The flow ports 808 may be configured to allow the completion fluid D to bypass the reverse activated plug device 704 when the reverse activated plug device 704 is in its open position. Upon moving the reverse activated plug device 704 to its closed position, however, the flow ports 808 may be occluded and thereby prevent the completion fluid D from bypassing the reverse activated plug device 704. More particularly, as the upper mandrel 702*a* is picked upwards, the collet protrusions 712 are forced against the seal bore 636 and eventually into the reduced-diameter portion 736 defined in the upper mandrel 702*a* between the upper and lower shoulders 720*a,b*, as generally described above. During this process, the dogs 714 are able to radially expand and release the upper mandrel 702*a*, thereby allowing the proximal end 728 of the intermediate mandrel 702*c* to move axially downward and simultaneously bringing the sealing element 810 into sealing engagement with the inner wall of the upper mandrel 702*a* and also occluding the ports 808 such that the completion fluid D is thereby prevented from bypassing the reverse activated plug device 704.

In FIG. 8C, the reverse activated plug device 704 may include a ported shoulder 812 extending from or otherwise forming part of the proximal end 728 of the intermediate mandrel 702*c*. The ported shoulder 812 may include one or more flow ports 814 (one shown) and a sealing surface 816. The flow ports 814 may be configured to allow the completion fluid D to bypass the reverse activated plug device 704 when the reverse activated plug device 704 is in its open position. Upon moving the reverse activated plug device 704 to its closed position, however, the flow ports 814 may be occluded and thereby prevent the completion fluid D from bypassing the reverse activated plug device 704. More particularly, as the upper mandrel 702*a* is picked upwards, the collet protrusions 712 are forced against the seal bore 636 and eventually into the reduced-diameter portion 736 defined in the upper mandrel 702*a* between the upper and lower shoulders 720*a,b*, as generally described above. During this process, the dogs 714 are able to radially expand and release the upper mandrel 702*a*, thereby allowing the proximal end 728 of the intermediate mandrel 702*c* to move axially downward and simultaneously bringing the sealing surface 816 into sealing engagement with the plug seat 726 and also occluding the ports 814 such that the completion fluid D is thereby prevented from bypassing the reverse activated plug device 704.

As will be appreciated, several additional alternative embodiments to the reverse activated plug device 704 may be employed, without departing from the scope of the disclosure. Those skilled in the art will readily recognize that the embodiments depicted in FIGS. 8A-8C are shown merely for illustrative purposes in further describing the limits of the present disclosure.

Embodiments disclosed herein include:

A. A reverse-out valve that includes a first mandrel, a second mandrel movable with respect to the first mandrel, a collet arranged about the first mandrel and having a cover portion and a plurality of fingers that extend axially from the cover portion, wherein each finger provides a collet protrusion defined thereon, a plurality of dogs movably arranged within a corresponding plurality of windows defined in the first mandrel, and a reverse activated plug device movable between an open position, where the plurality of dogs are disposed within a groove defined in the second mandrel and a reverse-circulation fluid is able to bypass the reverse activated plug device, and a closed position, where the plurality of dogs are moved out of the groove and the reverse-circulation fluid is prevented from bypassing the reverse activated plug device.

B. A system that includes a completion string disposable within a wellbore and including one or more sand screens arranged adjacent a subterranean formation, a service tool configured to be arranged within the completion string and including a first mandrel and a second mandrel movable with respect to the first mandrel, and a reverse activated plug device arranged on the service tool and comprising a collet arranged about the first mandrel and having a cover portion and a plurality of fingers that extend axially from the cover portion, wherein each finger provides a collet protrusion defined thereon, the reverse activated plug device further comprising a plurality of dogs movably arranged within a corresponding plurality of windows defined in the first mandrel, wherein the reverse activated plug device is movable between an open position, where the plurality of dogs are disposed within a groove defined in the second mandrel and a reverse-circulation fluid introduced into the service tool is able to bypass the reverse activated plug device, and a closed position, where the plurality of dogs are moved out of the groove and the reverse-circulation fluid is prevented from bypassing the reverse activated plug device.

C. A method that includes arranging a completion string within a wellbore providing one or more zones of interest within a subterranean formation, the completion string including one or more sand screens arranged adjacent the one or more zones of interest, introducing a service tool at least partially into the completion string, the service tool including a first mandrel and a second mandrel movable with respect to the first mandrel, conveying a reverse-out fluid into the service tool and past a reverse activated plug device arranged on the service tool, the reverse activated plug device comprising a collet arranged about the first mandrel and a plurality of dogs movably arranged within a corresponding plurality of windows defined in the first mandrel, the collet having a cover portion and a plurality of fingers that extend axially from the cover portion, and moving the reverse activated plug device from an open position, where the plurality of dogs are disposed within a groove defined in the second mandrel and the reverse-circulation fluid bypasses the reverse activated plug device, to a closed position, where the plurality of dogs are moved out of the groove and the reverse-circulation fluid is prevented from bypassing the reverse activated plug device.

Each of embodiments A, B, and C may have one or more of the following additional elements in any combination: Element 1: further comprising a biasing device arranged between the collet and a lower shoulder of the first mandrel, wherein, when the reverse activated plug device is in the open position, the biasing device urges the collet against an upper shoulder of the first mandrel and covers the corresponding plurality of windows with the cover portion and thereby maintains the plurality of dogs within the groove. Element 2: wherein the reverse activated plug device further comprises a plug device ball disposed above a plug seat defined on an interior of the second mandrel, wherein, when the reverse activated plug device is in the closed position, the plug device ball sealingly engages the plug seat. Element 3: wherein the reverse activated plug device further comprises a flapper having a torsion spring and being movable between a first position, where a proximal end of the second mandrel holds the flapper open such that the reverse-circulation fluid is able to bypass the reverse activated plug device, and a second position, where the proximal end of the second mandrel is moved to allow the torsion spring to close the flapper and thereby prevent the reverse-circulation fluid from bypassing the reverse activated plug device. Element 4: wherein the reverse activated plug device further comprises a ported end extending from a proximal end of the second mandrel, one or more flow ports defined in the ported end and allowing the reverse-circulation fluid to bypass the reverse activated plug device when in the open position, and one or more sealing elements arranged on the ported end and configured to provide a sealed interface between the ported end and an inner wall of the first mandrel when the reverse activated plug device is in the closed position. Element 5: wherein the reverse activated plug device further comprises a ported shoulder extending from a proximal end of the second mandrel, one or more flow ports defined in the ported shoulder and allowing the reverse-circulation fluid to bypass the reverse activated plug device when in the open position, and a sealing surface arranged on the ported shoulder and configured to seal against a plug seat defined on the first mandrel when the reverse activated plug device is in the closed position. Element 6: further comprising a ball check arranged below the reverse activated plug device and providing an axial fluid passageway that allows a metered portion of a fluid to pass therethrough when the reverse activated plug device is in the open position.

Element 7: further comprising a biasing device arranged between the collet and a lower shoulder of the first mandrel, wherein, when the reverse activated plug device is in the open position, the biasing device urges the collet against an upper shoulder of the first mandrel and covers the corresponding plurality of windows with the cover portion and thereby maintains the plurality of dogs within the groove. Element 8: wherein the reverse activated plug device further comprises a plug device ball disposed above a plug seat defined on an interior of the second mandrel, wherein, when the reverse activated plug device is in the closed position, the plug device ball sealingly engages the plug seat. Element 9: wherein the reverse activated plug device further comprises a flapper having a torsion spring and being movable between a first position, where a proximal end of the second mandrel holds the flapper open such that the reverse-circulation fluid is able to bypass the reverse activated plug device, and a second position, where the proximal end of the second mandrel is moved to allow the torsion spring to close the flapper and thereby prevent the reverse-circulation fluid from bypassing the reverse activated plug device. Element 10: wherein the reverse activated plug device further comprises a ported end extending from a proximal end of the second mandrel, one or more flow ports defined in the ported end and allowing the reverse-circulation fluid to bypass the reverse activated plug device when in the open position, and one or more sealing elements arranged on the ported end and configured to provide a sealed interface between the ported end and an inner wall of the first mandrel when the reverse activated plug device is in the closed position. Element 11: wherein the reverse activated plug device further comprises a ported shoulder extending from a proximal end of the second mandrel, one or more flow ports defined in the ported shoulder and allowing the reverse-circulation fluid to bypass the reverse activated plug device when in the open position, and a sealing surface arranged on the ported shoulder and configured to seal against a plug seat defined on the first mandrel when the reverse activated plug device is in the closed position. Element 12: further comprising a ball check arranged below the reverse activated plug device in the service tool and providing an axial fluid passageway that allows a metered portion of a fluid to pass therethrough when the reverse activated plug device is in the open position. Element 13: wherein the metered portion of the fluid maintains hydrostatic pressure on the adjacent subterranean formation in order to mitigate swabbing of the subterranean formation.

Element 14: wherein moving the reverse activated plug device from the open position comprises axially moving the service tool within the completion string such that collet protrusions defined on one or more of the plurality of fingers engage a seal bore provided on an inner wall of the completion string, urging the collet protrusions against the seal bore and thereby shifting the collet toward a lower shoulder of the second mandrel, the cover portion of the collet covering the plurality of windows, exposing the plurality of windows as the collet moves toward the lower shoulder, allowing the dog in each window to expand radially out of the groove and thereby release the second mandrel with respect to the first mandrel, and moving the first mandrel with respect to the second mandrel and thereby forcing the collet protrusions to flex radially inward beneath the seal bore and into a reduced-diameter portion of the second mandrel. Element 15: wherein the reverse activated plug device further comprises a biasing device arranged between the collet and the lower shoulder of the second mandrel, the method further comprising reducing a pressure of the reverse-circulation fluid within the service tool below a pressure threshold, placing an axial compression load on the service tool to move the first mandrel with respect to the second mandrel and thereby allowing the dog in each window to radially contract and be seated within the groove, moving the collet protrusions out of radial engagement with the seal bore and thereby allowing spring force built up in the biasing device to urge the collet toward an upper shoulder defined on the second mandrel, and covering the windows with the cover portion to maintain the dog of each window within the groove as the collet moves toward the upper shoulder. Element 16: wherein the reverse activated plug device further comprises a plug device ball disposed above a plug seat defined on an interior of the second mandrel, the method further comprising holding the plug device ball separated from the plug seat with a proximal end of the second mandrel when the reverse activated plug device is in the open position, and thereby allowing the reverse-out fluid to bypass the plug device ball, and sealingly engaging the plug device ball against the plug seat when the reverse activated plug device is in the closed position and thereby preventing the reverse-circulation fluid from bypassing the reverse activated plug device. Element 17: wherein the reverse activated plug device further comprises a flapper having a torsion spring, and wherein moving the first mandrel with respect to the second mandrel comprises holding the flapper in a first position where a proximal end of the second mandrel holds the flapper open such that the reverse-circulation fluid is able to bypass the reverse activated plug device, and moving the flapper to a second position where the proximal end of the second mandrel is moved to allow the torsion spring to close the flapper and thereby prevent the reverse-circulation fluid from bypassing the reverse activated plug device. Element 18: wherein the reverse activated plug device further includes a ported end extending from a proximal end of the second mandrel, and wherein moving the first mandrel with respect to the second mandrel comprises allowing the reverse-circulation fluid to bypass the reverse activated plug device via one or more flow ports defined in the ported end when the reverse activated plug device is in the open position, and generating a sealed interface between the ported end and an inner wall of the first mandrel when the reverse activated plug device is moved to the closed position, the sealed interface being generated by one or more sealing elements arranged on the ported end. Element 19: wherein the reverse activated plug device further includes a ported shoulder extending from a proximal end of the second mandrel and wherein moving the first mandrel with respect to the second mandrel comprises, allowing the reverse-circulation fluid to bypass the reverse activated plug device via one or more flow ports defined in the ported shoulder when the reverse activated plug device is in the open position, and sealingly engaging a sealing surface arranged on the ported shoulder with a plug seat defined on the first mandrel when the reverse activated plug device is in the closed position. Element 20: further comprising receiving the reverse-out fluid at a ball check axially-offset from the reverse activated plug device within the service tool, sealingly engaging the ball check against a valve seat with upon receiving the reverse-out fluid at the ball check, flowing a metered portion of the reverse-out fluid through an axial fluid passageway defined in the ball check, and maintaining hydrostatic pressure on the subterranean formation with the metered portion of the reverse-circulation fluid. Element 21: further comprising axially moving the first mandrel with respect to the second mandrel, and allowing a fluid to pass through the axial fluid passageway in order to mitigate swabbing effects on the subterranean formation.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A reverse-out valve, comprising:

a first mandrel;

a second mandrel movable with respect to the first mandrel;

a collet arranged about the first mandrel and having a cover portion and a plurality of fingers that extend axially from the cover portion, wherein each finger provides a collet protrusion defined thereon;

a plurality of dogs movably arranged within a corresponding plurality of windows defined in the first mandrel;

a reverse activated plug device movable between an open position, where the plurality of dogs are disposed within a groove defined in the second mandrel and a reverse-circulation fluid is able to bypass the reverse activated plug device, and a closed position, where the plurality of dogs are moved out of the groove and the reverse-circulation fluid is prevented from bypassing the reverse activated plug device; and a biasing device arranged between the collet and a lower shoulder of the first mandrel, wherein, when the reverse activated plug device is in the open position, the biasing device urges the collet against an upper shoulder of the first mandrel and covers the corresponding plurality of windows with the cover portion and thereby maintains the plurality of dogs within the groove.

2. The reverse-out valve of claim 1, wherein the reverse activated plug device further comprises a plug device ball disposed above a plug seat defined on an interior of the second mandrel, wherein, when the reverse activated plug device is in the closed position, the plug device ball sealingly engages the plug seat.

3. The reverse-out valve of claim 1, wherein the reverse activated plug device further comprises a flapper having a torsion spring and being movable between a first position, where a proximal end of the second mandrel holds the flapper open such that the reverse-circulation fluid is able to bypass the reverse activated plug device, and a second position, where the proximal end of the second mandrel is moved to allow the torsion spring to close the flapper and thereby prevent the reverse-circulation fluid from bypassing the reverse activated plug device.

4. The reverse-out valve of claim 1, wherein the reverse activated plug device further comprises:

a ported end extending from a proximal end of the second mandrel;

one or more flow ports defined in the ported end and allowing the reverse-circulation fluid to bypass the reverse activated plug device when in the open position; and one or more sealing elements arranged on the ported end and configured to provide a sealed interface between the ported end and an inner wall of the first mandrel when the reverse activated plug device is in the closed position.

5. The reverse-out valve of claim 1, wherein the reverse activated plug device further comprises:

a ported shoulder extending from a proximal end of the second mandrel;

one or more flow ports defined in the ported shoulder and allowing the reverse-circulation fluid to bypass the reverse activated plug device when in the open position; and a sealing surface arranged on the ported shoulder and configured to seal against a plug seat defined on the first mandrel when the reverse activated plug device is in the closed position.

6. The reverse-out valve of claim 1, further comprising a ball check arranged below the reverse activated plug device and providing an axial fluid passageway that allows a metered portion of a fluid to pass therethrough when the reverse activated plug device is in the open position.

7. A system, comprising:

a completion string disposable within a wellbore and including one or more sand screens;

a service tool arranged within the completion string and including a first mandrel and a second mandrel movable with respect to the first mandrel; and a reverse activated plug device arranged on the service tool and including:

a collet arranged about the first mandrel and having a cover portion and a plurality of fingers that extend axially from the cover portion, wherein each finger provides a collet protrusion defined thereon;

a plurality of dogs movably arranged within a corresponding plurality of windows defined in the first mandrel; and a biasing device arranged between the collet and a lower shoulder of the first mandrel, wherein the reverse activated plug device is movable between an open position, where the plurality of dogs are disposed within a groove defined in the second mandrel and a reverse-circulation fluid introduced into the service tool is able to bypass the reverse activated plug device, and a closed position, where the plurality of dogs are moved out of the groove and the reverse-circulation fluid is prevented from bypassing the reverse activated plug device, and wherein, when the reverse activated plug device is in the open position, the biasing device urges the collet against an upper shoulder of the first mandrel and covers the corresponding plurality of windows with the cover portion and thereby maintains the plurality of dogs within the groove.

8. The system of claim 7, wherein the reverse activated plug device further comprises a plug device ball disposed above a plug seat defined on an interior of the second mandrel, wherein, when the reverse activated plug device is in the closed position, the plug device ball sealingly engages the plug seat.

9. The system of claim 7, wherein the reverse activated plug device further comprises a flapper having a torsion spring and being movable between a first position, where a proximal end of the second mandrel holds the flapper open such that the reverse-circulation fluid is able to bypass the reverse activated plug device, and a second position, where the proximal end of the second mandrel is moved to allow the torsion spring to close the flapper and thereby prevent the reverse-circulation fluid from bypassing the reverse activated plug device.

10. The system of claim 7, wherein the reverse activated plug device further comprises:

a ported end extending from a proximal end of the second mandrel;

one or more flow ports defined in the ported end and allowing the reverse-circulation fluid to bypass the reverse activated plug device when in the open position; and one or more sealing elements arranged on the ported end and configured to provide a sealed interface between the ported end and an inner wall of the first mandrel when the reverse activated plug device is in the closed position.

11. The system of claim 7, wherein the reverse activated plug device further comprises:

a ported shoulder extending from a proximal end of the second mandrel;

one or more flow ports defined in the ported shoulder and allowing the reverse-circulation fluid to bypass the reverse activated plug device when in the open position; and a sealing surface arranged on the ported shoulder and configured to seal against a plug seat defined on the first mandrel when the reverse activated plug device is in the closed position.

12. The system of claim 7, further comprising a ball check arranged below the reverse activated plug device in the service tool and providing an axial fluid passageway that allows a metered portion of a fluid to pass therethrough when the reverse activated plug device is in the open position.

13. The system of claim 12, wherein the metered portion of the fluid maintains hydrostatic pressure on the adjacent subterranean formation in order to mitigate swabbing of the subterranean formation.

14. A method, comprising:

arranging a completion string including one or more sand screens within a wellbore;

introducing a service tool at least partially into the completion string, the service tool including a first mandrel and a second mandrel movable with respect to the first mandrel;

conveying a reverse-out fluid into the service tool and past a reverse activated plug device arranged on the service tool, the reverse activated plug device including:

a collet arranged about the first mandrel and a plurality of dogs movably arranged within a corresponding plurality of windows defined in the first mandrel, the collet having a cover portion and a plurality of fingers that extend axially from the cover portion; and a biasing device arranged between the collet and the lower shoulder of the second mandrel to urge the collet against an upper shoulder of the first mandrel and cover the corresponding plurality of windows with the cover portion and thereby maintain the plurality of dogs within the groove; and moving the reverse activated plug device from an open position, where the plurality of dogs are disposed within a groove defined in the second mandrel and the reverse-circulation fluid bypasses the reverse activated plug device, to a closed position, where the plurality of dogs are moved out of the groove and the reverse-circulation fluid is prevented from bypassing the reverse activated plug device.

15. The method of claim 14, wherein moving the reverse activated plug device from the open position comprises:

axially moving the service tool within the completion string such that collet protrusions defined on one or more of the plurality of fingers engage a seal bore provided on an inner wall of the completion string;

urging the collet protrusions against the seal bore and thereby shifting the collet toward a lower shoulder of the second mandrel, the cover portion of the collet covering the plurality of windows;

exposing the plurality of windows as the collet moves toward the lower shoulder;

allowing the dog in each window to expand radially out of the groove and thereby release the second mandrel with respect to the first mandrel; and moving the first mandrel with respect to the second mandrel and thereby forcing the collet protrusions to flex radially inward beneath the seal bore and into a reduced-diameter portion of the second mandrel.

16. The method of claim 15, further comprising:

reducing a pressure of the reverse-circulation fluid within the service tool below a pressure threshold;

placing an axial compression load on the service tool to move the first mandrel with respect to the second mandrel and thereby allowing the dog in each window to radially contract and be seated within the groove;

moving the collet protrusions out of radial engagement with the seal bore and thereby allowing spring force built up in the biasing device to urge the collet toward an upper shoulder defined on the second mandrel; and covering the windows with the cover portion to maintain the dog of each window within the groove as the collet moves toward the upper shoulder.

17. The method of claim 15, wherein the reverse activated plug device further comprises a plug device ball disposed above a plug seat defined on an interior of the second mandrel, the method further comprising:

holding the plug device ball separated from the plug seat with a proximal end of the second mandrel when the reverse activated plug device is in the open position, and thereby allowing the reverse-out fluid to bypass the plug device ball; and sealingly engaging the plug device ball against the plug seat when the reverse activated plug device is in the closed position and thereby preventing the reverse-circulation fluid from bypassing the reverse activated plug device.

18. The method of claim 15, wherein the reverse activated plug device further comprises a flapper having a torsion spring, and wherein moving the first mandrel with respect to the second mandrel comprises:

holding the flapper in a first position where a proximal end of the second mandrel holds the flapper open such that the reverse-circulation fluid is able to bypass the reverse activated plug device; and moving the flapper to a second position where the proximal end of the second mandrel is moved to allow the torsion spring to close the flapper and thereby prevent the reverse-circulation fluid from bypassing the reverse activated plug device.

19. The method of claim 15, wherein the reverse activated plug device further includes a ported end extending from a proximal end of the second mandrel, and wherein moving the first mandrel with respect to the second mandrel comprises:

allowing the reverse-circulation fluid to bypass the reverse activated plug device via one or more flow ports defined in the ported end when the reverse activated plug device is in the open position; and generating a sealed interface between the ported end and an inner wall of the first mandrel when the reverse activated plug device is moved to the closed position, the sealed interface being generated by one or more sealing elements arranged on the ported end.

20. The method of claim 15, wherein the reverse activated plug device further includes a ported shoulder extending from a proximal end of the second mandrel and wherein moving the first mandrel with respect to the second mandrel comprises:

allowing the reverse-circulation fluid to bypass the reverse activated plug device via one or more flow ports defined in the ported shoulder when the reverse activated plug device is in the open position; and sealingly engaging a sealing surface arranged on the ported shoulder with a plug seat defined on the first mandrel when the reverse activated plug device is in the closed position.

21. The method of claim 14, further comprising:

receiving the reverse-out fluid at a ball check axially-offset from the reverse activated plug device within the service tool;

sealingly engaging the ball check against a valve seat upon receiving the reverse-out fluid at the ball check;

flowing a metered portion of the reverse-out fluid through an axial fluid passageway defined in the ball check; and maintaining hydrostatic pressure on the subterranean formation with the metered portion of the reverse-circulation fluid.

22. The method of claim 21, further comprising:

axially moving the first mandrel with respect to the second mandrel; and allowing a fluid to pass through the axial fluid passageway in order to mitigate swabbing effects on the subterranean formation.

* * * * *